US011243014B2

(12) United States Patent
Bao et al.

(10) Patent No.: US 11,243,014 B2
(45) Date of Patent: Feb. 8, 2022

(54) CRYOCOOLER

(71) Applicant: SUMITOMO HEAVY INDUSTRIES, LTD., Tokyo (JP)

(72) Inventors: Qian Bao, Nishitokyo (JP); Changheng Liu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 216 days.

(21) Appl. No.: 16/568,226

(22) Filed: Sep. 11, 2019

(65) Prior Publication Data

US 2020/0003458 A1 Jan. 2, 2020

Related U.S. Application Data

(63) Continuation of application No. PCT/JP2018/004852, filed on Feb. 13, 2018.

(30) Foreign Application Priority Data

Mar. 13, 2017 (JP) ..... JP2017-047781

(51) Int. Cl.
*F25B 9/00* (2006.01)
*F25B 13/00* (2006.01)
*F25D 29/00* (2006.01)

(52) U.S. Cl.
CPC ..... *F25B 9/002* (2013.01); *F25B 13/00* (2013.01); *F25D 29/001* (2013.01);
(Continued)

(58) Field of Classification Search
CPC .. F25B 9/002; F25B 9/14; F25B 13/00; F25B 2309/006; F25B 2309/1411;
(Continued)

(56) References Cited

U.S. PATENT DOCUMENTS 4,333,755 A * 6/1982 Sarcia ..... F25B 9/14 137/625.37
4,446,701 A * 5/1984 Suzuki ..... F25B 9/14 60/520

(Continued)

FOREIGN PATENT DOCUMENTS

JP S58-47970 A 3/1983
JP 2001-241796 A 9/2001

(Continued)

*Primary Examiner* — Emmanuel E Duke
(74) *Attorney, Agent, or Firm* — HEA Law PLLC

(57) ABSTRACT

A cryocooler includes a displacer, a cylinder that forms an expansion space, a Scotch yoke mechanism configured to drive the displacer in a reciprocating manner, a first rod that extends from the Scotch yoke mechanism, a housing that includes an assist chamber, a rotary valve configured to switch between a state in which the expansion space and a discharge side of a compressor are connected and the assist chamber and a suction side of the compressor are connected and a state in which the expansion space and the suction side of the compressor are connected and the assist chamber and the discharge side of the compressor are connected, a motor configured to drive the Scotch yoke mechanism and the rotary valve, and an on-off valve configured to open and close a gas flow path through which the rotary valve and the assist chamber are connected.

4 Claims, 7 Drawing Sheets

(52) U.S. Cl.
CPC ... *F25B 2309/006* (2013.01); *F25B 2313/027* (2013.01); *F25B 2313/031* (2013.01); *F25B 2700/19* (2013.01)

(58) Field of Classification Search
CPC ..... F25B 2313/027; F25B 2313/031; F25B 2700/19; F25B 49/025; F25D 29/001
See application file for complete search history.

(56) References Cited

U.S. PATENT DOCUMENTS

| | | | | |
|---|---|---|---|---|
| 5,361,588 | A * | 11/1994 | Asami | F25B 9/14 60/520 |
| 9,395,108 | B2 | 7/2016 | Morie et al. | |
| 2011/0061404 | A1* | 3/2011 | Ishizuka | F25B 9/14 62/6 |
| 2012/0317994 | A1* | 12/2012 | Matsubara | F25B 9/14 62/6 |
| 2014/0202173 | A1* | 7/2014 | Morie | F25B 9/14 62/6 |
| 2014/0318155 | A1* | 10/2014 | Morie | F25B 9/14 62/6 |
| 2017/0051952 | A1 | 2/2017 | Morie | |

FOREIGN PATENT DOCUMENTS

| | | | |
|---|---|---|---|
| JP | 2014-139498 | A | 7/2014 |
| JP | 2017-40386 | A | 2/2017 |
| WO | 93/10407 | A1 | 5/1993 |

* cited by examiner

CRYOCOOLER

RELATED APPLICATIONS

The contents of Japanese Patent Application No. 2017-047781, and of International Patent Application No. PCT/JP2018/004852, on the basis of each of which priority benefits are claimed in an accompanying application data sheet, are in their entirety incorporated herein by reference.

BACKGROUND

Technical Field

A certain embodiment of the present invention relates to a cryocooler in which high-pressure refrigerant gas is expanded to generate coldness.

Description of Related Art

As an example of a cryocooler which generates cryogenic temperatures, a Gifford-McMahon (GM) cryocooler is known. In the GM cryocooler, a displacer reciprocates in a cylinder, and thus, a volume in an expansion space is changed. The expansion space is selectively connected to a discharge side and a suction side of a compressor according to the change of the volume, and thus, the refrigerant gas is expanded in the expansion space.

In Japanese Unexamined Patent Application Publication No. 58-47970, a cryocooler including an assist chamber is disclosed. The assist chamber accommodates a distal end of a rod extending from a reciprocating drive mechanism configured to drive a displacer in a reciprocating manner. In this cryocooler, the assist chamber is selectively connected to the discharge side and the suction side of the compressor, and thus the pressure in the assist chamber assists the movement of the rod and hence the displacer, thereby reducing the load applied to the reciprocating drive mechanism.

SUMMARY

According to an embodiment of the present invention, there is provided a cryocooler including: a displacer; a cylinder that accommodates the displacer and is configured such that as the displacer reciprocates, it forms an expansion space between the displacer and the cylinder; a reciprocating drive mechanism configured to drive the displacer in a reciprocating manner; an assist rod that extends toward a side opposite to the displacer from the reciprocating drive mechanism; a housing that includes a drive mechanism accommodation chamber accommodating the reciprocating drive mechanism and an assist chamber accommodating a distal end of the assist rod; a switch valve configured to switch between a state in which the expansion space and a discharge side of a compressor are connected and the assist chamber and a suction side of the compressor are connected and a state in which the expansion space and the suction side of the compressor are connected and the assist chamber and the discharge side of the compressor are connected; a reversible motor configured to drive the switch valve; and an on-off valve configured to open and close a gas flow path through which the switch valve and the assist chamber are connected.

DETAILED DESCRIPTION

Figure 1:
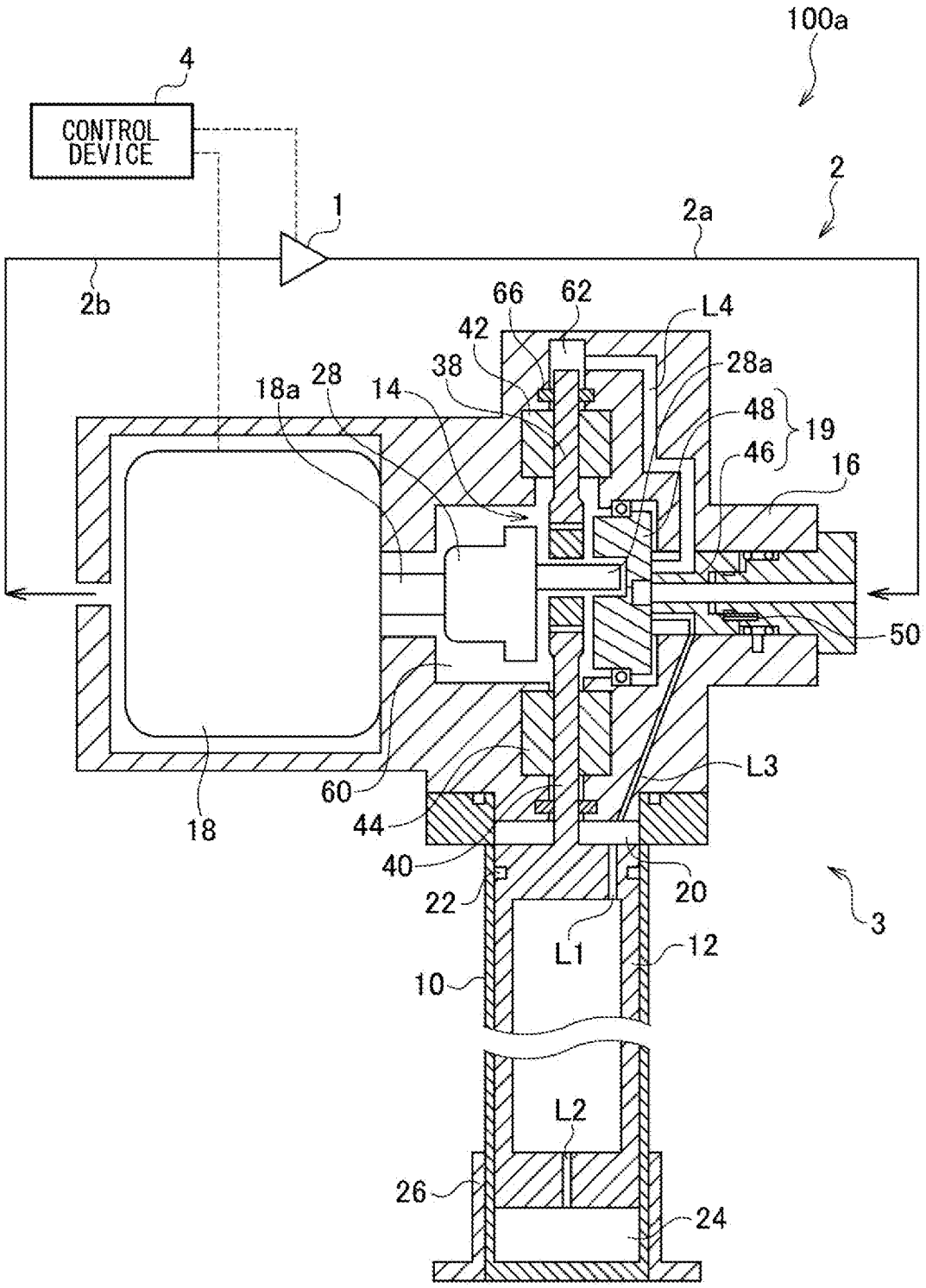
FIG. 1 is a schematic sectional view showing an internal structure of a cryocooler according to a comparative example.

The refrigeration cycle of the cryocooler may be reversed in order to heat an object. In this case, the pressure in the assist chamber hinders the movement of the rod and hence the displacer, and the load applied to the reciprocating drive mechanism is rather increased.

It is desirable to provide a cryocooler in which a road applied to a reciprocating drive mechanism configured to drive a displacer in a reciprocating manner can be reduced.

In addition, arbitrary combinations of the above-described components, or components or expression of the present invention may be replaced by each other in methods, devices, systems, or the like, and these replacements are also included in aspects of the present invention.

According to the present invention, it is possible to decrease a load applied to a reciprocating drive mechanism configured to drive a displacer in a reciprocating manner.

Hereinafter, the same reference numerals are assigned to the same or the corresponding components, members, and processes shown in each drawing, and overlapping descriptions thereof are appropriately omitted. Moreover, for easy understanding, dimensions of members in each drawing are appropriately enlarged and decreased. In addition, in descriptions with respect to embodiments in each drawing, members which are not important are shown so as to be partially omitted.

COMPARATIVE EXAMPLE

Figure 2:
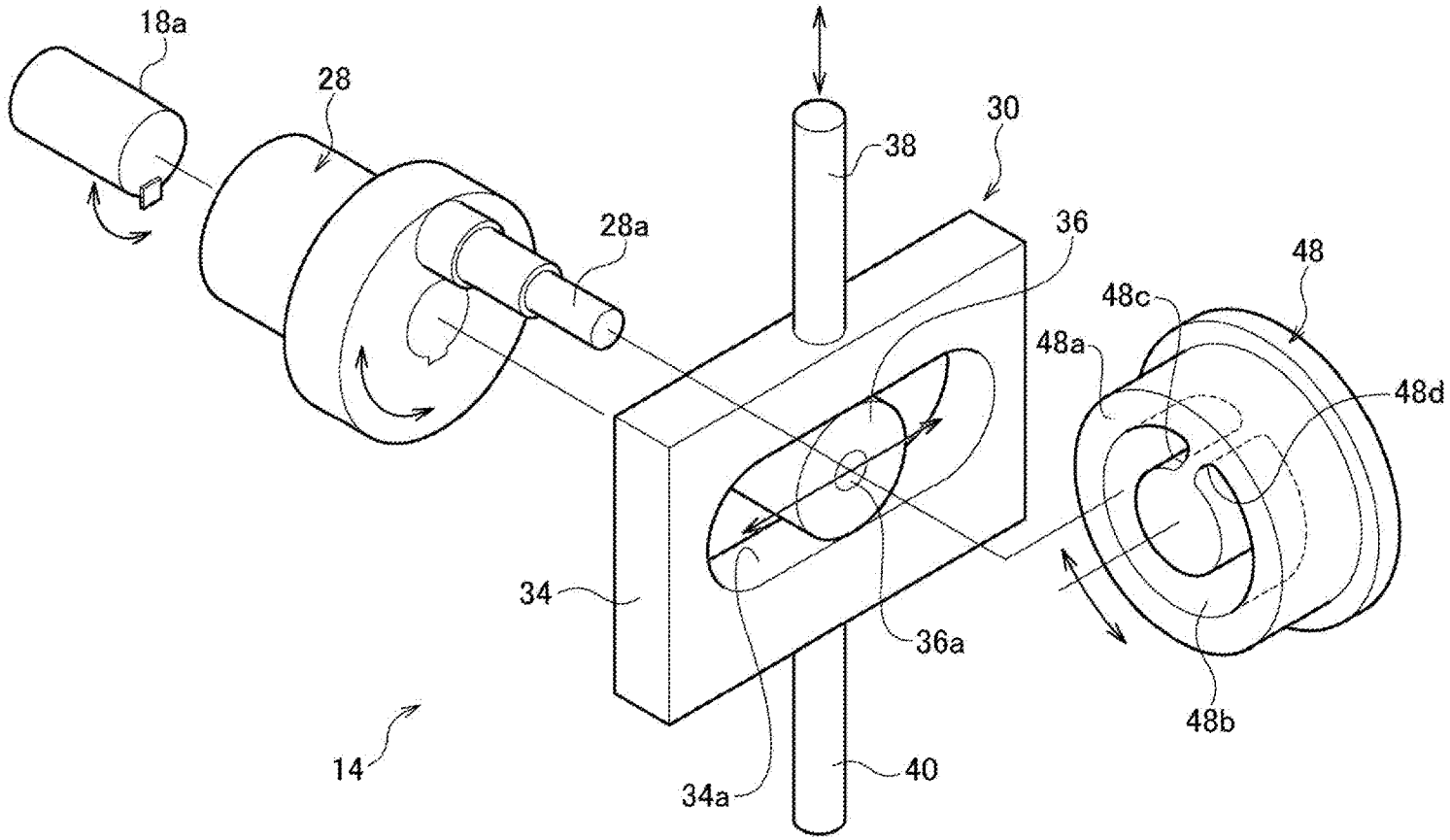
FIG. 2 is an exploded perspective view of a Scotch yoke mechanism.

Before a cryocooler according to an embodiment is described, a cryocooler according to a comparative example to be compared with the embodiment is described. FIG. 1 is a schematic sectional view showing a cryocooler 100*a* according to the comparative example. FIG. 2 is an exploded perspective view of a Scotch yoke mechanism 14 and a rotor valve 48 of FIG. 1.

The cryocooler 100*a* is a Gifford-McMahon cryocooler (GM cryocooler). The cryocooler 100*a* is configured to perform a cooling operation for cooling an object and a temperature rising operation of heating an object. In the temperature rising operation, a refrigeration cycle of the cooling operation is reversed. In addition, the cryocooler 100*a* has a gas assist function of assisting the movement of a displacer by a pressure in an assist chamber. That is, the cryocooler 100*a* according to the comparative example is a cryocooler in which the gas assist function is added to a cryocooler that can perform the temperature rising operation.

The cryocooler 100*a* includes a compressor 1, a pipe 2, an expander 3, and a control device 4.

The compressor 1 compresses a low-pressure refrigerant gas which is returned from the expander 3, and supplies a compressed high-pressure refrigerant gas to the expander 3. The pipe 2 includes a high-pressure pipe 2*a* and a low-pressure pipe 2*b*. The high-pressure pipe 2*a* is connected to a discharge side of the compressor 1. A high-pressure refrigerant gas flows through the high-pressure pipe 2*a* from the compressor 1 toward the expander 3. The low-pressure pipe 2*b* is connected to a suction side of the compressor 1. A low-pressure refrigerant gas flows through the low-pressure pipe 2*b* from the expander 3 toward the compressor 1. For example, helium gas can be used as the refrigerant gas. In addition, nitrogen gas or other gas may be used as the refrigerant gas.

The expander 3 expands the high-pressure refrigerant gas supplied from the compressor 1, and thus, generates coldness. The expander 3 includes a cylinder 10, a displacer 12, a Scotch yoke mechanism 14, a housing 16, a motor 18, a rotary valve (switch valve) 19, a first rod (assist rod) 38, and a second rod 40.

Hereinafter, in order to easily show positional relationships of the components of the expander 3, a term such as an "axial direction" may be used. The axial direction indicates a direction in which the first rod 38 and the second rod 40 extend. The axial direction is coincident with a direction in which the displacer 12 moves. For convenience, a portion which is relatively close to an expansion space 24 or a cooling stage 26 (both will be described below) in the axial direction may be referred to as a "lower portion", and a portion which is relatively far from the expansion space 24 or the cooling stage 26 may be referred to as an "upper portion". In addition, the above-described expressions are not related to disposition of the expander 3 when the expander 3 is attached.

The cylinder 10 has a bottomed cup shape in which a cylindrical portion and a bottom portion are integrally formed, and accommodates the displacer 12 such that the displacer 12 can reciprocate in the axial direction. For example, the cylinder 10 is formed of a stainless steel considering strength, thermal conductivity, and the like.

The displacer 12 reciprocates between a top dead center and a bottom dead center in the cylinder 10. Here, the top dead center indicates the position of the expansion space 24 when the volume of the expansion space 24 is the maximum volume, and the bottom dead center indicates the position of the expansion space 24 when the volume of the expansion space 24 is the minimum volume. The displacer 12 has a cylindrical outer peripheral surface, and the inside of the displacer 12 is filled with a regenerator material (not shown). For example, from the viewpoint of specific weight, strength, thermal conductivity, and the like, the displacer 12 is formed of a resin such as bakelite (fabric-containing phenol). For example, the regenerator material is configured of a wire mesh or the like.

A gas flow path L1 through which a gas chamber 20 and the inside of the displacer 12 communicate with each other is formed above the displacer 12. Here, the gas chamber 20 is a space which is formed by the cylinder 10 and an upper end of the displacer 12. The volume of the gas chamber 20 is changed by reciprocation of the displacer 12.

A gas flow path L2 through which the inside of the displacer 12 and the expansion space 24 communicate with each other is formed below the displacer 12. Here, the expansion space 24 is a space which is formed by the cylinder 10 and a lower end of the displacer 12. The volume of the expansion space 24 is changed according to the reciprocation of the displacer 12. The cooling stage 26 which is thermally connected to a cooling object (not shown) is disposed at a position on the outer periphery of the cylinder 10 corresponding to the expansion space 24. The cooling stage 26 is cooled by the refrigerant gas inside the expansion space 24.

A seal 22 is provided between the inner peripheral surface of the cylinder 10 and the displacer 12. Accordingly, the flow of the refrigerant gas between the gas chamber 20 and the expansion space 24 is performed via the inside of the displacer 12.

The motor 18 is a reversible motor and rotates a rotation shaft 18*a* thereof in a forward or reverse direction. In the comparative example, the cryocooler 100*a* performs the cooling operation when the rotation shaft 18*a* is rotated in the forward direction, and performs the temperature rising operation when the rotation shaft 18*a* is rotated in the reverse direction.

The Scotch yoke mechanism 14 drives the displacer 12 in a reciprocating manner. The Scotch yoke mechanism 14 includes a crank 28 and a Scotch yoke 30.

The crank 28 is fixed to the rotation shaft 18*a* of the motor 18. The crank 28 includes a crank pin 28*a* at a position which is eccentric from a position at which the rotation shaft 18*a* is fixed to the crank 28. Accordingly, if the crank 28 is fixed to the rotation shaft 18*a*, the crank pin 28*a* is eccentric to the rotation shaft 18*a*.

The Scotch yoke 30 includes a yoke plate 34 and a roller bearing 36. The yoke plate 34 is a plate-shaped member. The first rod 38 is connected to an upper center portion of the Scotch yoke 30 so as to extend upward, and the second rod 40 is connected to a lower center portion of the Scotch yoke 30 so as to extend downward. The first rod 38 is supported by a first sliding bearing 42 so as to be movable in the axial direction, and the second rod 40 is supported by a second sliding bearing 44 so as to be movable in the axial direction. Accordingly, the first rod 38 and the second rod 40, and hence the yoke plate 34 and the Scotch yoke 30 are configured to be movable in the axial direction.

A horizontally long window 34*a* is formed at the center of the yoke plate 34. The horizontally long window 34*a* extends in a direction which intersects, for example, is perpendicular to the direction (that is, axial direction) in which the first rod 38 and the second rod 40 extend.

The roller bearing 36 is disposed in the horizontally long window 34*a* so as to be rollable. An engagement hole 36*a* which engages with the crank pin 28*a* is formed at the center of the roller bearing 36, and the crank pin 28*a* penetrates the engagement hole 36*a*.

If the motor 18 is driven to rotate the rotation shaft 18*a*, the roller bearing 36 engaging with the crank pin 28*a* is rotated so as to draw a circle. The roller bearing 36 is rotated so as to draw a circle, and thus, the Scotch yoke 30 reciprocates in the axial direction. In this case, the roller bearing 36 reciprocates in the horizontally long window 34*a* in a direction intersecting the axial direction.

The displacer 12 is connected to the second rod 40. Accordingly, the Scotch yoke 30 moves in the axial direction, and thus, the displacer 12 reciprocates in the cylinder 10 in the axial direction.

The housing 16 includes a drive mechanism accommodation chamber 60 and an assist chamber 62. The Scotch yoke mechanism 14 is accommodated in the drive mechanism accommodation chamber 60. The drive mechanism accommodation chamber 60 communicates with the suction side of the compressor 1 via the low-pressure pipe 2*b*. Accordingly, the pressure of the drive mechanism accommodation chamber 60 is maintained so as to be a low pressure which is approximately the same as the pressure of the suction side of the compressor 1.

The upper end portion of the first rod 38 is accommodated in the assist chamber 62. A seal 66 is provided on a lower portion of the assist chamber 62. The seal 66 airtightly separates the assist chamber 62 from the drive mechanism accommodation chamber 60 while allowing the movement of the first rod 38 in the axial direction. For example, a slipper seal or a clearance seal can be used as the seal 66. In addition, the first sliding bearing 42 and the seal 66 may be integrated with each other.

A gas flow path L3 of which one end communicates with the gas chamber 20 and the other end communicates with the rotary valve 19 is formed in the housing 16. A gas flow path L4 of which one end communicates with the assist chamber 62 and the other end communicates with the rotary valve 19 is formed in the housing 16.

The rotary valve 19 is provided in a flow path of the refrigerant gas from the compressor 1 to the gas chamber 20 and the assist chamber 62. The rotary valve 19 includes a stator valve 46 and a rotor valve 48. The stator valve 46 is fixed to the housing 16 by a pin 50 so as not to be rotated. The rotor valve 48 is rotatably supported in the housing 16.

An arc-shaped engagement groove 48*b* is formed on an end surface 48*a*, which is on the Scotch yoke mechanism 14 side, of the rotor valve 48, a distal end of the crank pin 28*a* of the Scotch yoke mechanism 14 is inserted into the engagement groove 48*b*. If the crank pin 28*a* is rotated in the forward or reverse direction according to the rotation of the rotation shaft 18*a* of the motor 18, and the crankpin 28*a* engages with an end portion 48*c* which is on one side of the engagement groove 48*b* in a circumferential direction or an end portion 48*d* which is on the other side of the engagement groove 48*b* in the circumferential direction, the motion of the crank 28, that is, the rotation of the rotation shaft 18*a* of the motor 18 is transferred to the rotor valve 48, and the rotor valve 48 is rotated in the forward or reverse direction with respect to the stator valve 46. The engagement groove 48*b* and the crank pin 28*a* connect the rotor valve 48 to the rotation shaft 18*a* of the motor 18 between the forward rotation and the reverse rotation with a lost motion of a predetermined angle (for example, 280°).

The stator valve 46 and the rotor valve 48 configure an expansion-space supply valve through which a high-pressure working gas discharged from the compressor 1 is introduced into the expansion space 24 via the gas chamber 20, an assist-chamber supply valve through which a high-pressure working gas discharged from the compressor 1 is introduced into the assist chamber 62, an expansion-space exhaust valve through which the working gas is introduced from the expansion space 24 to the compressor 1 via the gas chamber 20, and an assist-chamber exhaust valve through which the working gas is introduced from the assist chamber 62 to the compressor 1. The expansion-space supply valve, the assist-chamber supply valve, the expansion-space exhaust valve, the assist-chamber exhaust valve are opened or closed according to the rotation of the rotor valve 48.

As described above, since the engagement groove 48*b* and the crank pin 28*a* connect the rotor valve 48 to the rotation shaft 18*a* of the motor 18 between the forward rotation and the reverse rotation with a lost motion of a predetermined angle, the opening timing and the closing timing of each of the expansion-space supply valve, the assist-chamber supply valve, the expansion-space exhaust valve, and the assist-chamber exhaust valve with respect to the reciprocation of the displacer 12 are different between in a case where the rotation shaft 18*a* and the rotor valve 48 are rotated in the forward direction (that is, the cryocooler 100*a* performs the cooling operation) and in a case where the rotation shaft 18*a* and the rotor valve 48 are rotated in the reverse direction (that is, the cryocooler 100*a* performs the temperature rising operation).

If the expansion-space supply valve is opened, the high-pressure working gas from the compressor 1 is supplied to the gas chamber 20 through the gas flow path L3. Meanwhile, if the expansion-space exhaust valve is opened, the working gas having a low pressure is recovered to the compressor 1 from the gas chamber 20 via the gas flow path L3.

If the assist-chamber supply valve is opened, the assist chamber 62 is connected to the discharge side of the compressor 1 via the gas flow path L4, and thus becomes a high-pressure state. If the assist-chamber exhaust valve is opened, the assist chamber 62 is connected to the suction side of the compressor 1 via the gas flow path L4, and thus becomes a low-pressure state.

The assist chamber 62 is airtightly separated from the drive mechanism accommodation chamber 60 as described above. In addition, the pressure of the drive mechanism accommodation chamber 60 is maintained so as to be a low pressure as described above. Accordingly, if the refrigerant gas of the assist chamber 62 becomes a high-pressure state, a downward force in the axial direction acts on the first rod 38 by the pressure difference between the assist chamber 62 and the drive mechanism accommodation chamber 60. Since the first rod 38 is connected to the displacer 12 via the Scotch yoke mechanism 14, the displacer 12 is biased downward in the axial direction by the force. That is, the pressure of the working gas supplied to the assist chamber 62 may operate as an assist force which assists the displacer 12 when the displacer 12 is moved downward by the Scotch yoke mechanism 14. By applying the assist force at an appropriate timing, it is possible to decrease the loads applied to the Scotch yoke mechanism 14 and the motor 18.

Figure 3:
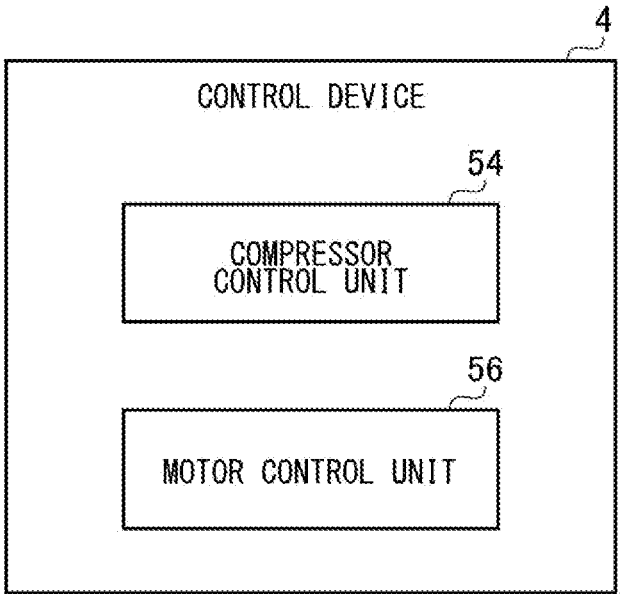
FIG. 3 is a block diagram showing a functional configuration of a control device of FIG. 1.

FIG. 3 is a block diagram showing a functional configuration of the control device 4 of FIG. 1. Each block shown in FIG. 3 can be realized by an element or a mechanical device including a central processing unit (CPU) of a computer in a hardware manner, and can be realized by a computer program or the like in a software manner. Here, each block indicates a functional block which is realized by cooperation thereof. Accordingly, a person skilled in the art understands that the functional blocks may be realized in various manners by combination of software and hardware. This is similarly applied to FIG. 6.

The control device 4 includes a compressor control unit 54 and a motor control unit 56. The compressor control unit 54 controls the operation of the compressor 1. For example, the compressor control unit 54 controls the compressor 1 such that a pressure difference between a high pressure and a low pressure of the compressor 1 becomes a target pressure. The motor control unit 56 controls the driving of the motor 18. For example, the motor control unit 56 rotates the rotation shaft 18*a* of the motor 18 in the forward or reverse direction at a desired rotating speed.

Figure 4:
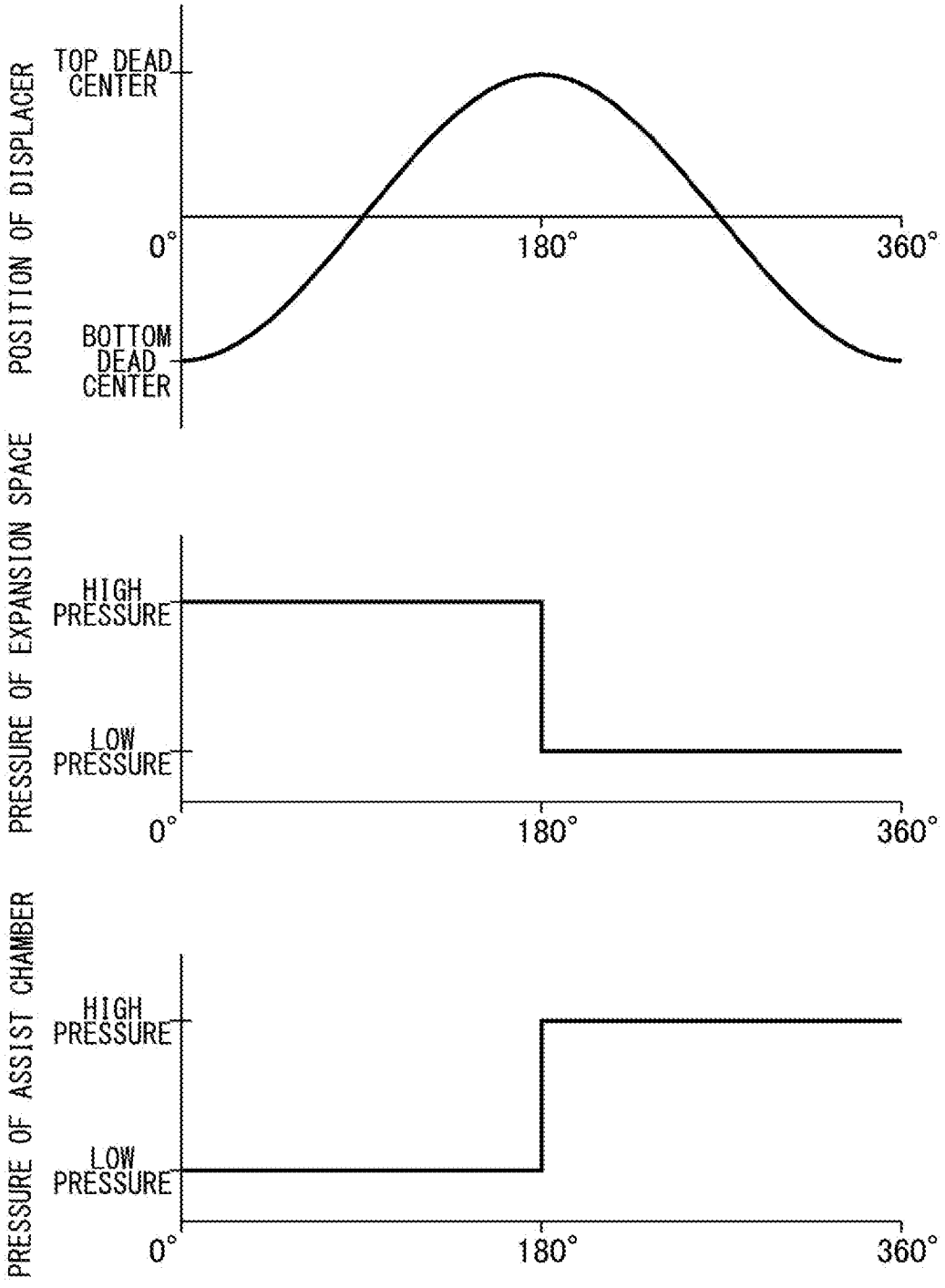
FIG. 4 is graphs showing a relationship between a position of a displacer, a pressure of an expansion space, and a pressure of an assist chamber of the cryocooler according to the comparative example.

FIG. 4 is graphs showing a relationship between a position of the displacer 12, a pressure of the expansion space 24, and a pressure of the assist chamber 62 of the cryocooler 100*a* according to the comparative example. In FIG. 4, the horizontal axis indicates a rotation angle of the motor 18 and the rotor valve 48. 180° is an angle when the displacer 12 is positioned at the top dead center, that is, when the volume of the expansion space 24 is the maximum volume, and 0° (360°) is an angle when the displacer 12 is positioned at the bottom dead center, that is, when the volume of the expansion space 24 is the minimum volume. The operation of the cryocooler 100*a* is described with reference to FIGS. 1 and 4.

First, a case in which the cryocooler 100*a* performs the cooling operation is described. In the cooling operation, the crankpin 28*a* engages with the end portion 48*c* of the engagement groove 48*b* of the rotor valve 48 according to the forward rotation of the motor 18, and thereby the rotor valve 48 is rotated in the forward direction.

The displacer 12 starts to move from the bottom dead center toward the top dead center (the motor 18 and the rotor valve 48 start to rotate from 0° toward 180°). In this case, the expansion-space supply valve and the assist-chamber exhaust valve are opened, and the assist-chamber supply valve and the expansion-space exhaust valve are closed. Therefore, the assist chamber 62 is connected to the suction side of the compressor 1 via the low-pressure pipe 2*b* and the assist-chamber exhaust valve, and becomes a low-pressure state. In this case, a high-pressure refrigerant gas flows from the compressor 1 into the gas chamber 20 via the high-pressure pipe 2*a* and the expansion-space supply valve. The high-pressure refrigerant gas flows into the inside of the displacer 12 through the gas flow path L1, and is cooled by the regenerator material. The cooled refrigerant gas flows into the expansion space 24 through the gas flow path L2. Accordingly, the inside of the expansion space 24 becomes a high-pressure state.

The expansion-space supply valve and the assist-chamber exhaust valve are closed before the displacer 12 reaches the top dead center. Then, the assist-chamber supply valve and the expansion-space exhaust valve are opened immediately before the displacer 12 reaches the top dead center. Accordingly, the assist chamber 62 is connected to the discharge side of the compressor 1 via the high-pressure pipe 2*a* and the assist-chamber supply valve, and thus becomes a high-pressure state. In addition, the refrigerant gas inside the expansion space 24 becomes a low-pressure state from a high-pressure state, and is expanded. As a result, the temperature of the refrigerant gas inside the expansion space 24 further decreases. In addition, the cooling stage 26 is cooled by the refrigerant gas of which the temperature has decreased.

If the displacer 12 reaches the top dead center, continuously, the displacer 12 starts to move from the top dead center toward the bottom dead center (the motor 18 and the rotor valve 48 start to rotate from 180° toward 360°). In this case, the downward movement of the displacer 12 is assisted by the pressure of the working gas inside the assist chamber 62 which is in the high-pressure state. In addition, the low-pressure refrigerant gas cools the regenerator material according to a route which is reverse to the above-described route, and is returned to the compressor 1 via the expansion-space exhaust valve and the low-pressure pipe 2*b*.

The assist-chamber supply valve and the expansion-space exhaust valve are closed before the displacer 12 reaches the bottom dead center. Then, if the expansion-space supply valve and the assist-chamber exhaust valve are opened immediately before the displacer 12 reaches the bottom dead center, a high-pressure refrigerant gas flows from the compressor 1 into the gas chamber 20 via the high-pressure pipe 2*a* and the expansion-space supply valve again. If the displacer 12 reaches the bottom dead center, continuously, the displacer 12 starts to move from the bottom dead center toward the top dead center (the motor 18 and the rotor valve 48 start to rotate from 0° toward 180°).

The above-described operations are set to one cycle, and by repeating the refrigeration cycle, the object which is thermally connected to the cooling stage 26 is cooled.

Subsequently, a case in which the cryocooler 100*a* performs the temperature rising operation is described. In the temperature rising operation, the crank pin 28*a* engages with the end portion 48*d* of the engagement groove 48*b* of the rotor valve 48 according to the reverse rotation of the motor 18, and thereby the rotor valve 48 is rotated in the reverse direction.

The displacer 12 starts to move from the bottom dead center toward the top dead center (the motor 18 and the rotor valve 48 start to rotate from 360° toward 180° in the reverse direction). As soon as the displacer 12 starts to move, the expansion-space supply valve and the assist-chamber exhaust valve are closed, and then, the assist-chamber supply valve and the expansion-space exhaust valve are opened. Accordingly, the assist chamber 62 is connected to the discharge side of the compressor 1 via the high-pressure pipe 2*a* and the assist-chamber supply valve, and thus becomes a high-pressure state. In addition, the refrigerant gas inside the expansion space 24 becomes a low-pressure state from a high-pressure state, and is expanded. The refrigerant gas of which the temperature has decreased is discharged to the suction side of the compressor 1 via the gas chamber 20.

The assist-chamber supply valve and the expansion-space exhaust valve are closed before the displacer 12 reaches the top dead center. Then, the expansion-space supply valve and the assist-chamber exhaust valve are opened immediately before the displacer 12 reaches the top dead center. Therefore, the assist chamber 62 is connected to the suction side of the compressor 1 via the low-pressure pipe 2*b* and the assist-chamber exhaust valve, and becomes a low-pressure state. In this case, a high-pressure refrigerant gas flows from the compressor 1 into the gas chamber 20 via the high-pressure pipe 2*a* and the expansion-space supply valve.

If the displacer 12 reaches the top dead center, continuously, the displacer 12 starts to move from the top dead center toward the bottom dead center (the motor 18 and the rotor valve 48 start to rotate from 180° toward 0°). The high-pressure refrigerant gas flows into the inside of the displacer 12 through the gas flow path L1, and flows into the expansion space 24 through the gas flow path L2. Accordingly, the inside of the expansion space 24 becomes a high-pressure state. In this case, since the displacer 12 moves toward the bottom dead center, the refrigerant gas in the expansion space 24 is further compressed, and has a higher pressure, and the temperature thereof is increased.

If the displacer 12 reaches the bottom dead center, continuously, the displacer 12 starts to move from the bottom dead center toward the top dead center (the motor 18 and the rotor valve 48 start to rotate from 360° toward 180°).

The above-described operations are set to one cycle, and by repeating the temperature rising cycle, the object which is thermally connected to the cooling stage 26 is heated.

As described above, in the temperature rising cycle, when the displacer 12 moves from the bottom dead center toward the top dead center (when the motor 18 and the rotor valve 48 rotate from 360° toward 180° in the reverse direction), the assist chamber 62 becomes the high-pressure state. A downward force in the axial direction acts on the first rod 38 by the pressure difference between the assist chamber 62 and the drive mechanism accommodation chamber 60. That is, a force in a direction opposite to the movement direction of the displacer 12 acts on the first rod 38. This may become a load hindering the movement of the displacer 12 and hence the rotation of the Scotch yoke mechanism 14 and the motor 18. As a result, power consumption for rotating the motor 18 in the reverse direction may be increased. Alternatively, the motor 18 may not be operated due to the allowable torque of the motor 18 being exceeded. That is, as the cryocooler 100*a* according to the comparative example, if the assist function is added to the cryocooler configured to perform the temperature rising operation, such problems may occur.

Embodiment

Figure 5:
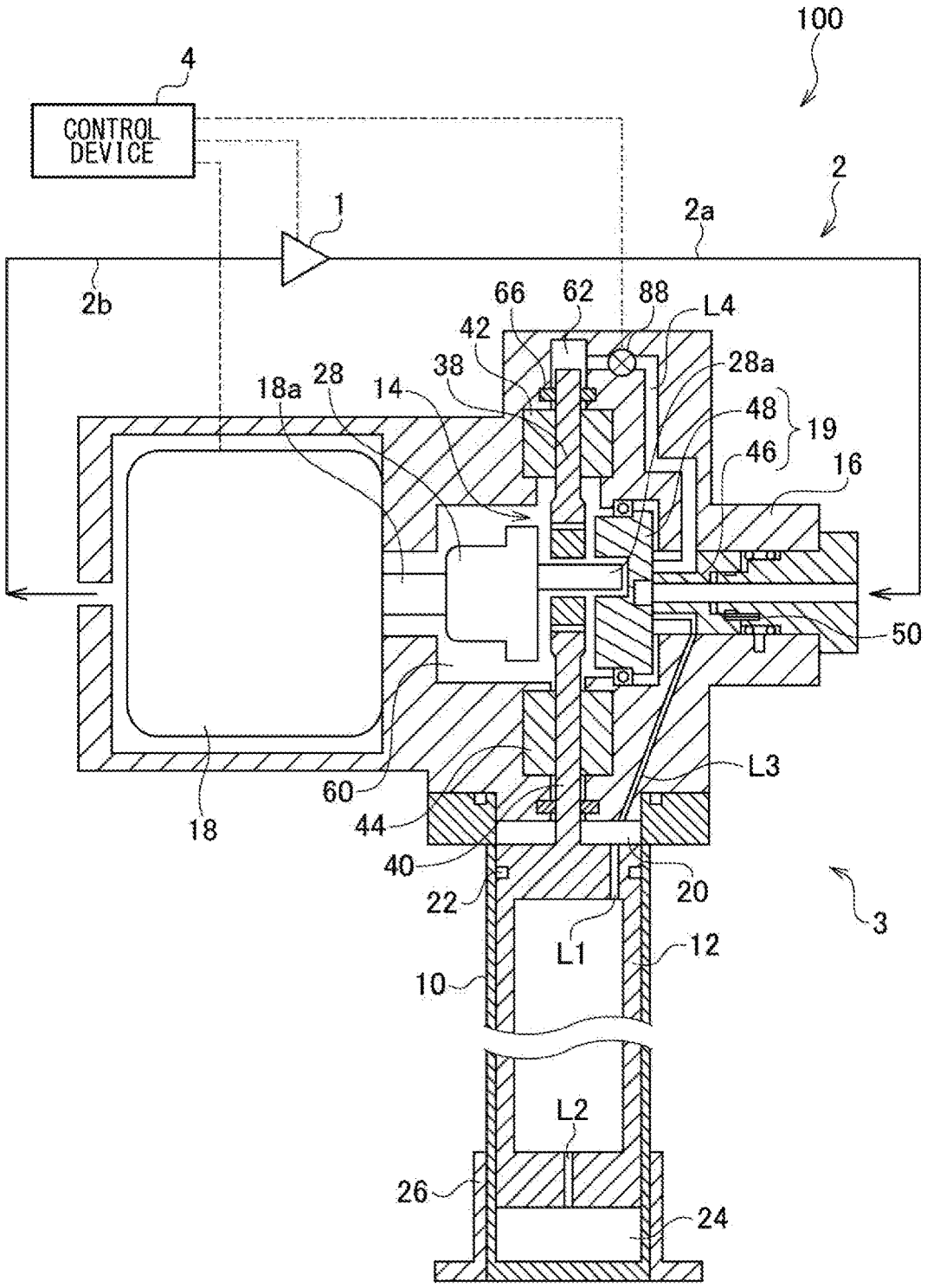
FIG. 5 is a schematic sectional view showing an internal structure of a cryocooler according to an embodiment.

FIG. 5 is a schematic view showing a cryocooler 100 according to the embodiment. A difference between FIG. 1 and FIG. 5 is mainly described.

The cryocooler 100 includes an on-off valve 88 for opening and closing the gas flow path L4, on the gas flow path L4. The on-off valve 88 is a solenoid valve in this embodiment, and is controlled by the control device 4.

Figure 6:
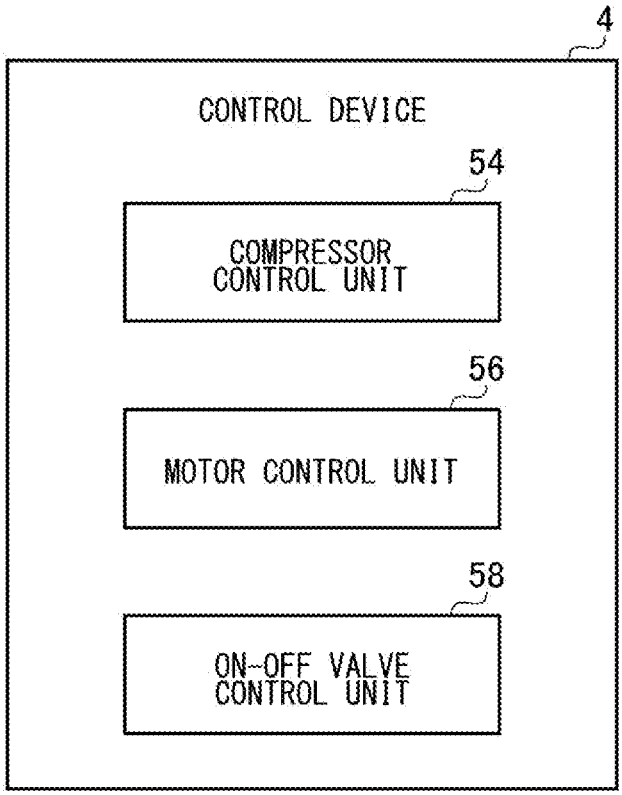
FIG. 6 is a block diagram showing a functional configuration of a control device of FIG. 5.

FIG. 6 is a block diagram showing a functional configuration of the control device 4. A difference between FIG. 3 and FIG. 6 is mainly described. The control device 4 includes a compressor control unit 54, a motor control unit 56, and an on-off valve control unit 58.

The on-off valve control unit 58 controls the opening and closing of the on-off valve 88. The on-off valve control unit 58 opens the on-off valve 88 in a case where the cryocooler 100 performs the cooling operation, that is, in a case where the motor 18 rotates in the forward direction.

In addition, the on-off valve control unit 58 closes the on-off valve 88 when the cryocooler 100 starts to perform the temperature rising operation, that is, when the motor 18 starts to rotate in the reverse direction. Accordingly, the gas is not supplied to the assist chamber 62. Here, the assist chamber 62 is airtightly separated from the drive mechanism accommodation chamber 60 by the seal 66. However, strictly speaking, as long as the seal 66 allows the movement of the first rod 38 in the axial direction, the working gas may pass between the assist chamber 62 and the drive mechanism accommodation chamber 60. Accordingly, if the on-off valve 88 is closed when the assist chamber 62 is the high-pressure state, the working gas in the assist chamber 62 leaks into the drive mechanism accommodation chamber 60 so that the pressure in the assist chamber 62 becomes almost the same as that in the drive mechanism accommodation chamber 60, that is, the assist chamber 62 becomes a state close to a low-pressure state.

Thus, in the embodiment, since the assist chamber 62 becomes a low-pressure state when the displacer 12 moves from the bottom dead center toward the top dead center in the temperature rising operation (when the motor 18 and the rotor valve 48 rotate from 360° toward 180° in the reverse direction), a force in a direction opposite to the movement direction of the displacer 12, which acts on the first rod 38 is reduced. That is, the load hindering the rotation of the Scotch yoke mechanism 14 and the motor 18 is reduced as compared with the comparative example. Thus, power consumption for rotating the motor 18 in the reverse direction is reduced. In addition, the possibility that the motor 18 is not operated due to the allowable torque of the motor 18 being exceeded is also reduced.

With the cryocooler 100 according to the embodiment described above, when the cryocooler 100 starts to perform the temperature rising operation, the on-off valve 88 is closed, and the assist chamber 62 and the discharge side of the compressor 1 are disconnected from each other. The working gas in the assist chamber 62 leaks into the drive mechanism accommodation chamber 60 through a slight gap between the seal 66 and the first rod 38. Therefore, the assist chamber 62 becomes almost the same as that in the drive mechanism accommodation chamber 60, that is, the assist chamber 62 becomes a state close to a low-pressure state. In this manner, it is possible to inhibit the working gas in the assist chamber 62 from being a load hindering the movement of the displacer 12 and hence the rotation of the Scotch yoke mechanism 14 and the motor 18 when the displacer 12 moves from the bottom dead center toward the top dead center.

In addition, with the cryocooler 100 according to the embodiment, the on-off valve 88 is a solenoid valve, and the control device 4 starts to rotate the motor 18 in the reverse direction and closes the on-off valve 88. Accordingly, it is not necessary for the user to close the on-off valve 88, and thus the load on the user is reduced.

Hereinbefore, the cryocooler according to the embodiment is described. The embodiment is exemplified, and a person skilled in the art understands that various modification examples are applied to combinations of components or processing processes and the modification examples are included in the scope of the present invention. Hereinafter, a modification example will be described.

Modification Example 1

The case in which the on-off valve control unit 58 closes the on-off valve 88 when the cryocooler 100 starts to perform the temperature rising operation, that is, when the motor 18 starts to rotate in the reverse direction has been described in the embodiment, but the invention is not limited thereto. The on-off valve 88 may be closed at any timing.

Preferably, the on-off valve 88 is closed in a state where the pressure of the assist chamber 62 falls below a predetermined value (for example, a desired pressure close to a low pressure). More preferably, the on-off valve 88 is closed in a state where the pressure of the assist chamber 62 becomes substantially the same as that in the drive mechanism accommodation chamber 60, that is, the assist chamber 62 becomes a low-pressure state.

Figure 7:
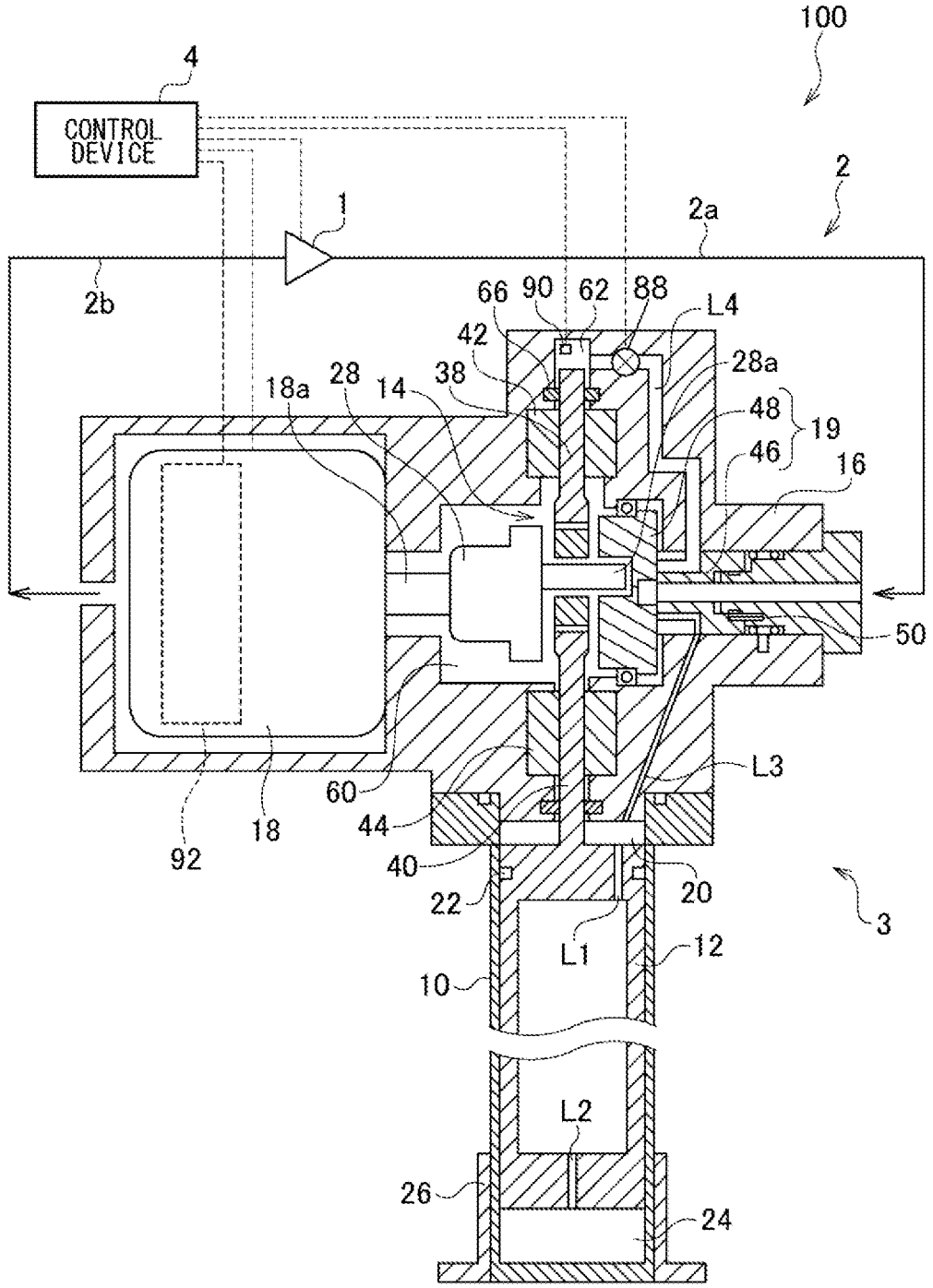
FIG. 7 is a schematic sectional view showing an internal structure of a cryocooler according to a modification example.

FIG. 7 is a schematic sectional view showing the cryocooler 100 according to the modification example. As shown in FIG. 7, the cryocooler 100 may further include a pressure sensor 90 configured to detect a pressure in the assist chamber 62 at a predetermined cycle. In this case, the on-off valve control unit 58 closes the on-off valve 88 when the temperature rising operation is started and the pressure in the assist chamber 62 detected by the pressure sensor falls below the predetermined value.

In addition, as shown in FIG. 7, the cryocooler 100 may further include an encoder 92. The encoder 92 may be incorporated in the motor 18 in advance. Here, since the rotor valve 48 and the rotation shaft 18*a* of the motor 18 are rotated in a synchronized manner, if the rotational angle of the rotation shaft 18*a* is known, the rotational angle of the rotor valve 48 is known, and whether the assist-chamber exhaust valve is opened, that is, whether the assist chamber 62 is a low-pressure state is known. Accordingly, in this case, when the on-off valve control unit 58 starts to perform the temperature rising operation and the rotational angle of the rotation shaft 18*a* becomes a rotational angle at which the assist-chamber exhaust valve has to be opened, the on-off valve 88 is closed.

Modification Example 2

The case in which when the on-off valve 88 is closed, the on-off valve 88 is kept closed has been described in the embodiment and the above-described modification example, but the present invention is not limited thereto. The on-off valve 88 may be closed for a partial period of time during the temperature rising operation. For example, the on-off valve 88 may be closed while the assist-chamber supply valve is opened. Specifically, in a case where the cryocooler 100 is configured as shown in FIG. 7, the on-off valve control unit 58 may close the on-off valve 88 before the assist-chamber supply valve is opened and may open the on-off valve 88 before the assist-chamber exhaust valve is opened.

Modification Example 3

The case in which the on-off valve 88 is a solenoid valve has been described in the embodiment, but the present invention is not limited thereto. The on-off valve 88 may be another type of on-off valve as long as the on-off valve 88 can open and close the gas flow path L4. The on-off valve 88 may be, for example, a mechanical switch valve. In this case, the on-off valve 88 may be manually closed, for example, before the motor 18 starts to be rotated in the reverse direction, at substantially the same time that the motor 18 starts to be rotated in the reverse direction, or immediately after the motor 18 starts to be rotated in the reverse direction.

Modification Example 4

The case in which the number of stages in the expander 3 of the cryocooler 100 is one has been described in the embodiment, but the present invention is not limited thereto. The number of stages of the expander 3 may be two or more.

It should be understood that the invention is not limited to the above-described embodiment, but may be modified into various forms on the basis of the spirit of the invention. Additionally, the modifications are included in the scope of the invention.

The present invention can be used in a cryocooler in which a high-pressure refrigerant gas is expanded to generate coldness.

What is claimed is:

1. A cryocooler comprising:

a displacer;

a cylinder that accommodates the displacer and is configured such that as the displacer reciprocates, an expansion space between the displacer and the cylinder is formed;

a reciprocating drive mechanism configured to drive the displacer in a reciprocating manner;

an assist rod that extends toward a side opposite to the displacer from the reciprocating drive mechanism;

a housing that includes a drive mechanism accommodation chamber accommodating the reciprocating drive mechanism and an assist chamber accommodating a distal end of the assist rod;

a switch valve configured to switch between a first state in which the expansion space and a discharge side of a compressor are connected and the assist chamber and a suction side of the compressor are connected, and a second state in which the expansion space and the suction side of the compressor are connected and the assist chamber and the discharge side of the compressor are connected;

a reversible motor configured to drive the switch valve; and an on-off valve configured to open and close a gas flow path through which the switch valve and the assist chamber are connected.

2. The cryocooler according to claim 1, wherein the switch valve connects the expansion space to the discharge side or the suction side of the compressor such that a working gas is expanded in the expansion space when the reversible motor rotates in a forward direction and the working gas is compressed in the expansion space when the reversible motor rotates in a reverse direction.

3. The cryocooler according to claim 2, wherein the on-off valve is a solenoid valve, wherein the cryocooler further includes a control device configured to control the solenoid valve, and wherein the control device closes the solenoid valve for at least a partial period during which the reversible motor rotates in the reverse direction.

4. The cryocooler according to claim 1, wherein the on-off valve is a solenoid valve, wherein the drive mechanism accommodation chamber is connected to the suction side of the compressor, wherein the cryocooler further includes a control device configured to control the reversible motor and the solenoid valve, and a detection unit configured to detect information on a pressure of the assist chamber, and wherein the control device closes the solenoid valve in a state where a detection result of the detection unit indicates that the pressure in the assist chamber falls below a predetermined value.

* * * * *